United States Patent [19]

Saeki et al.

[11] Patent Number: 4,800,193

[45] Date of Patent: Jan. 24, 1989

[54] RECORDING MATERIAL

[75] Inventors: Keiso Saeki; Masanobu Takashima; Ken Iwakura; Takekatsu Sugiyama; Masato Satomura, all of Shizuoka, Japan

[73] Assignee: Fuji Photo Film Co., Ltd., Kanagawa, Japan

[21] Appl. No.: 78,509

[22] Filed: Jul. 28, 1987

[30] Foreign Application Priority Data

Jul. 28, 1986 [JP] Japan ..... 61-177382
Jul. 30, 1986 [JP] Japan ..... 61-179444

[51] Int. Cl.[4] ..... B41M 5/16; B41M 5/18; B41M 5/22

[52] U.S. Cl. ..... 503/217; 427/151; 428/913; 428/914; 503/220; 503/223

[58] Field of Search ..... 427/150–153; 503/220, 223, 225, 216, 217; 549/307; 428/195, 913, 914

[56] References Cited

U.S. PATENT DOCUMENTS 4,062,866 12/1977 Garner et al. ..... 503/220
4,351,768 9/1982 Crounse et al. ..... 503/220

FOREIGN PATENT DOCUMENTS 1464251 2/1977 United Kingdom ..... 503/220

*Primary Examiner*—Bruce H. Hess

*Attorney, Agent, or Firm*—Sughrue, Mion, Zinn, Macpeak & Seas

[57] ABSTRACT

A recording material comprising an electron-donating colorless dye and an electron accepting compound, wherein said electron-donating colorless dye is represented by the following general formula (I):

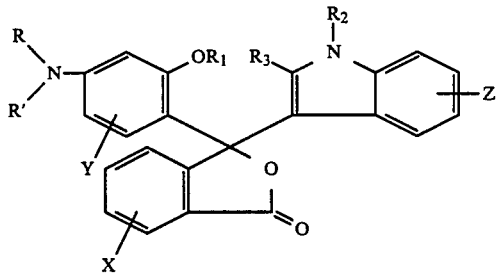

(I)

wherein R and R' each represents an alkyl group; $R_1$ represents an aralkyl group, or an alkyl group substituted with an alkoxy or aryloxy group; $R_2$ and $R_3$, which may be the same or different, each represents a hydrogen atom, an alkyl group, or an aryl group; and X, Y, and Z, which may be the same or different, each represents a hydrogen atom, an alkyl group, an alkoxy group, an aryloxy group, a halogen atom, or a substituted amino group.

The recording material is excellent in light resistance and solubility in an organic solvent.

14 Claims, No Drawings

RECORDING MATERIAL

FIELD OF THE INVENTION

The present invention relates to a recording material, and more particularly, to a recording material utilizing an electron-donating colorless dye and an electron-accepting compound, which has improved color developability and shelf-life, and provides a color image of heightened stability.

BACKGROUND OF THE INVENTION

Recording materials utilizing a combination of an electron-donating colorless dye and an electron-accepting compound have already been well-known as pressure sensitive paper, heat sensitive paper, light- and pressure-sensitive paper, electro thermo-recording paper and so on.

Detailed descriptions of these papers are given, for instance, in British Pat. No. 2,140,449, U.S. Pat. Nos. 4,480,092 and 4,436,920, Japanese Patent Publication No. 23922/85, Japanese patent application (OPI) Nos. 179836/82, 123556/85 and 123557/85 (the term "OPI" as used herein means an "published unexamined Japanese patent application"), and so on.

The recording materials must have properties of (1) producing a sufficiently high color density of the developed image at a sufficiently high speed, (2) forming no fog, (3) producing a developed image which retains sufficient fastness after color development, (4) producing a developed image of an appropriate hue, and showing an aptitude for copying machines, (5) having a high signal to noise (S/N) ratio, (6) producing a developed color image having a sufficiently high chemical resistance, (7) being produced from dyes which are readily able to be dissolved in an organic solvent,and so on. However, recording materials which satisfy all of these requirements to perfection have not been obtained yet.

In particular, studies on improvements in characteristics of such recording materials have been actively pursued in response to the speeding-up of the recording system and the diversification of requirements in recent years.

As for the compounds capable of developing blue to bluishviolet color, diphenylmethane type compounds, triphenylmethane type compounds, phthalide compounds, Leuco-methylene Blue type compounds and the like have so far been known. However, these compounds possess their individual defects.

For instance, although 3,5-bis(p-dimethylaminophenyl)-6-dimethyl-aminophthalide (i.e., Crystal Violet lactone, abbreviated as CVL), develops a dark blue color at a high speed, it is very poor with respect to the light resistance of the color image it produces. On the other hand, although 3,7-bis(dimethylamino)-10-benzoylphenothiazine (i.e., benzoyl leuco methylene blue, abbreviated as BLMB), produces a color image having excellent light resistance, it develops its color at a very low speed and shows a very color formability in the reaction with an organic color developer.

Our attention has been directed to various characteristics of electron-donating colorless dyes and electron-accepting compounds, including solubilities in oil, solubilities in water, partition coefficients, pKa values, polarities of substituent groups, positions of substituent groups, changes in crystallinity and solubility upon use in a warmed condition and so on, and with which the development of excellent substances for recording materials and recording materials has been sought.

SUMMARY OF THE INVENTION

Therefore, an object of the present invention is to provide a recording material using substances characterized by having good solubilities in aromatic solvents and paraffin series solvents and satisfying other basic requirements, and thereby acquiring high color developability, excellent shelf life, and high stability of developed color image.

The above-described object of the present invention is attained by a recording material comprising an electron-donating colorless dye and an electron-accepting compound, wherein said electron-donating colorless dye is represented by the following general formula (I):

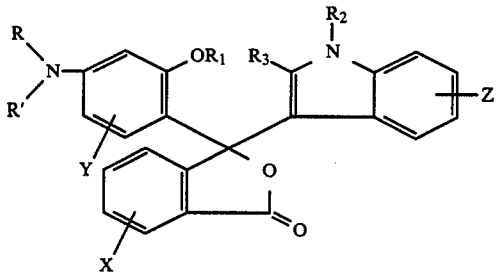

(I)

wherein R and R' each represents an alkyl group; $R_1$ represents an aralkyl group, or an alkyl group substituted with an alkoxy or aryloxy group; $R_2$ and $R_3$, which may be the same or different, each represents a hydrogen atom, an alkyl group, or an aryl group; and X, Y and Z, which may be the same or different, each represents a hydrogen atom, an alkyl group, an alkoxy group, an aryloxy group, a halogen atom, or a substituted amino group.

DETAILED DESCRIPTION OF THE INVENTION

The aryl group as used herein includes a phenyl group, a naphthyl group and an aromatic heterocyclic group such as a pyridine ring, an indole ring, a quinoline ring, a pyrrole ring, or a carbazole ring. These groups each may further have a substituent group, such as an alkyl group, an alkoxy group, an aryloxy group, a halogen atom, a nitro group, a cyano group, a substituted carbamoyl group (e.g., methyl carbamoyl group, ethyl carbamoyl group, butyl carbamoyl group, etc.), a substituted sulfamoyl group, a substituted amino group, a substituted oxycarbonyl group, a substituted oxysulfonyl group (e.g., methyloxysulfonyl group, ethyloxysulfonyl group, etc.) or the like. The substituted or unsubstituted aryl group preferably has 6 to 20 carbon atoms.

The alkyl group of R, R', $R_2$, $R_3$, X, Y, or Z of general formula (I) includes a saturated alkyl group, an unsaturated alkyl group such as an alkenyl group or an alkinyl group, and an alicyclic group having 5 to 8 carbon atoms. These groups each may further have a substituent group, such as an aryl group, an alkoxy group, an aryloxy group, a halogen atom, a cyano group or the like. The substituted or unsubstituted alkyl group preferably has 1 to 20 carbon atoms.

Of substituent groups represented by R or R', an alkyl group having 1 to 18 carbon atoms, an alkoxyalkyl group having 2 to 18 carbon atoms, an alkyl group substituted with a halogen atom, having 1 to 18 carbon atoms, and an aryloxyalkyl group having 7 to 18 carbon atoms are preferred. The substituent groups represented by R and R' may be the same or different.

Of substituent groups represented by $R_1$, an aralkyl group having 7 to 18 carbon atoms, an alkoxyalkyl group having 2 to 18 carbon atoms, and an aryloxyalkyl group having 7 to 18 carbon atoms are preferred, and an aryloxyalkyl group, (specifically, a β-aryloxyethyl group) is more preferred in view of light-fastness of the developed color image.

Of substituent groups represented by $R_2$, an alkyl group having 1 to 18 carbon atoms, which may be substituted with an aryl group, an alkoxy group, an aryloxy group or a halogen atom, a phenyl group having 6 to 12 carbon atoms, which may be substituted with an alkyl group, an alkoxy group or a halogen atom, and a hydrogen atom are preferred.

Of substituent groups represented by $R_3$, an alkyl group having 1 to 8 carbon atoms, a phenyl group having 6 to 10 carbon atoms, and a hydrogen atom are preferred.

Of substituent groups represented by X, Y and Z, respectively, a hydrogen atom, an alkoxy group having 1 to 6 carbon atoms, an aryloxy group having 6 to 10 carbon atoms, a chlorine atom, a bromine atom, an alkyl group having 1 to 12 carbon atoms, and a substituted amino group are preferred.

As the substituted amino group, a mono- or dialkylamino group having 1 to 12 carbon atoms, and a monoacylamino group havng 1 to 10 carbon atoms are preferred. Specific examples of the substituted amino group include a dimethylamino group, a diethylamino group, a dibutylamino group, an N-methylfurfurylamino group, an acetylamino group, and so on.

Of the electron-donating colorless dyes represented by formula (I), those of which solubility in di-isopropyl naphthalene, KMC-113 (made of Kureha Kagaku Kogyo Kabushiki Kaisha) at 25° C. is 3% or more, particularly 5% or more are preferred in solubility to an organic solvent such as aromatic solvents or paraffins.

The electron-donating colorless dyes, hereinafter referred to as color formers or colorless dyes, of the present invention are colorless or light colored crystals highly soluble in an organic solvent, and have an advantage in that contact with electron-accepting substances results in a rapid blue-coloration. The developed dyes are particularly advantageous from the standpoint of the long-range storage of records since they are highly stable, compared with dyes produced from conventional color formers, and hardly cause discoloration and/or fading even when exposed to light, heat or/and moisture for a long time. In addition, the color formers are excellent in stability, that is, they suffer no change in quality and no coloration even after long storage, and retain sufficiently high color formability. Therefore, the electron-donating colorless dyes of the present invention possess nearly ideal properties as a color former for pressure sensitive paper, heat sensitive paper and the like.

As typical examples of the elctron-donating colorless of dyes, of formula (I) which can be employed in the present invention, mention may be made of the following compounds, although the present invention is not to be construed as being limited thereto.

(1) 3-[4-diethylamino-2-(α-methoxypropoxy)phenyl]-3-(1-ethyl-2-methylindol-3-yl)phthalide
(2) 3-[4-diethylamino-2-(γ-methoxypropoxy)phenyl]-3-(1-n-butyl-2-methylindol-3-yl)phthalide
(3) 3-[4-diethylamino-2-(γ-methoxypropoxy)phenyl]-3-(1-isopentyl-2-methylindol-3-yl)phthalide
(4) 3-[4-diethylamino-2-(β-methoxyethoxy)phenyl]-3-(1-ethyl-2-methylindol-3-yl)phthalide
(5) 3-[4-diethylamino-2-(β-ethoxyethoxy)phenyl]-3-(1-ethyl-2-methylindol-3-yl)phthalide
(6) 3-[4-diethylamino-2-(γ-ethoxypropoxy)phenyl]-3-(1-ethyl-2-methylindol-3-yl)phthalide
(7) 3-[4-di-n-butylamino-2-(γ-ethoxypropoxy)phenyl]-3-(1-ethyl-2-methylindol-3-yl)phthalide
(8) 3-[4-diethylamino-2-(γ-ethoxypropoxy)phenyl]-3-(1-benzyl-2-methylindol-3-yl)phthalide
(9) 3-[4-ethyl-N-n-butylamino-2-(γ-ethoxypropoxy)-phenyl]-3-(1-ethyl-2-methylindol-3-yl)phthalide
(10) 3-[4-diethylamino-2-(γ-ethoxypropoxy)phenyl]-3-(1-ethyl-2-phenylindol-3-yl)phthalide
(11) 3-[4-diethylamino-2-(β-phenoxyethoxy)phenyl]-3-(1-ethyl-2methylindol]-3-yl)phthalide
(12) 3-[4-diethylamino-2-(β-4-chlorophenoxyethoxy)-phenyl]-3-(1-ethyl-2-methylindol-3-yl)phthalide
(13) 3-[4-diethylamino-2-(β-4-methylphenoxyethoxy)-phenyl]-3-(1-ethyl-2-methylindol-3-yl)phthalide
(14) 3-[4-diethylamino-2-(β-4-methoxyphenoxyethoxy)-phenyl]-3-(1-ethyl-2-methylindol-3-yl)phthalide
(15) 3-[4-diethylamino-2-benzyloxyphenyl)-3-(1-ethyl-2-methylindole-3-yl)phthalide
(16) 3-[4-diethylamino-2-(4-methylbenzyloxy)phenyl]-3-(1-ethyl-2-methylindol-3-yl)phthalde
(17) 3-[4-diethylamino-2-(4-isopropylbenzyloxy)-phenyl]-3-(1-ethyl-2-methylindole-3-yl)phthalide
(18) 3-[4-diethylamino-2-(4-chlorobenzyloxy)phenyl]-3-(1-ethyl-2-methylindol-3-yl)phthalide
(19) 3-[4-diethylamino-2-(4-methoxybenzyloxy)-phenyl]-3-(1-ethyl-2-methylindol-3-yl)phthalide
(20) 3-(4-dibutylamino-2-benzyloxyphenyl)-3-(1-ethyl-2-methylindol-3-yl)phthalide
(21) 3-(4-diethylamino-2-benzyloxyphenyl)-3-(1,2-dimethylindol-3-yl)phthalide
(22) 3-(4-diethylamino-2-benzyloxyphenyl)-3-(1-ethyl-2-phenylindol-3-yl)phthalide
(23) 3-[4-diethylamino-2-(β-phenethyloxy)phenyl]-3-(1-ethyl-2-methylindol-3-yl)phthalide
(24) 3-[4-diethylamino-2-(α-phenethyloxy)phenyl]-3-(1-ethyl-2-methylindol-3-yl)phthalide
(25) 3-[4-diethylamino-2-(β-phenethyloxy)phenyl]-3-(1-ethyl-2-iso-pentylindol-3-yl)phthalide
(26) 3-[4-diethylamino-2-(α-methoxypropoxy)phenyl]-3-(1-n-octyl-2-methylindol-3-yl)phthalide
(27) 3-[4-diethylamino-2-(β-phenoxyethoxy)phenyl]-3-(1-n-octyl-2-methylindol-3-yl)phthalide
(28) 3-[4-diethylamino-2-(β-4-methylphenoxyethoxy)-phenyl]-3-(1-n-octyl-2-methylindol-3-yl)phthalide
(29) 3-[4-diethylamino-2-(β-methoxyphenoxyethoxy)-phenyl]-3-(1-n-octyl-2-methylindol-3-yl)phthalide
(30) 3-[4-diethylamino-2-(β-methoxyphenoxyethoxy)-phenyl]-3-[1-(2-ethylhexyl)-2-methylindol-3-yl)phthalide
(31) 3-[4-diethylamino-2-(β-4-methoxyphenoxyethoxy)-phenyl]-3-(1-n-octadecyl-2-methylindol-3-yl)phthalide
(32) 3-[4-diethylamino-2-(4-methoxybenzyloxy)-phenyl]-3-(1-n-octyl-2-methylindol-3-yl)phthalide These novel colorless dyes each can constitute a recording material in combination with various already well-known compounds, such as triarylmethane compounds, fluoran compounds, thiazine compounds, indolylazalphthalide compounds, leuco auramine compounds, xanthene compounds, diphenylmethane compounds, triazene compounds, spiropyran compounds, and so on.

In using the colorless dyes of the present invention in combination with the foregoing known compounds, it is to be desired from the standpoint of improvements in characteristics that the fraction of the colorless dyes comprised by dyes of formula (I) should be 60 wt% or more.

Specific examples of triarylmethane compounds which can be used in combination with the dyes of formula (I) include 3,3-bis(p-dimethylaminophenyl)-6-dimethylaminophthalide (i.e., Crystal Violet lactone), 3,3-bis(p-dimethylaminophenyl)phthalide, 3-(p-dimethylaminophenyl)3-(1,3-dimethylindol-3-yl)phthalide, 3-(p-dimethylaminophenyl)-3-(2-methylindol-3-yl)phthalide, and so on.

Specific examples of diphenylmethane compounds which can be used in combination with the colorless dyes of formula (I) include 4,4'-bis-dimethylaminobenzhydrin benzyl ether, and so on.

Specific examples of leuco aramine compounds which can be used in combination with the dyes of formula (I) include N-halophenyl-Leucoauramine, N-2,4,5-trichlorophenyl-leuco-auramine, and so on.

Specific examples of xanthene compounds which can be used in combination with the dyes of formula (I) include Rhodamine-B-anilinolactam, Rhodamine-(p-nitroanilno)lactam, and Rhodamine-B-(p-chloroanilino)lactam.

Specific examples of fluoran compounds which can be used in combination with the dyes of formula (I) include 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminfluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phehyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfuoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichloro-fluoran, 2-o-toluidino-3-methyl-6-diisopropylamino-4',5'-dimethylaminofluoran, 2-anilino-3-ethyl-6-N-ethyl-N-isoamylaminofluoran, 2-anilino-3-methyl-6-N-ethyl-N-η-methoxypropylaminofluoran, 2-anilino-3-chloro-6-N-ethyl-N-isoamylaminofluoran, and so on.

Specific examples of thiazine compounds which can be used in combination with the colorless dyes of formula (I) include benzoyl leuco Methylene Blue, p-nitrobenzoyl leuco Methylene Blue, and so on.

Specific examples of spiropyran compounds which can be used in combination with the colorless dyes of formula (I) include 3-methyl-spiro-dinaphthopyran, 3-ethyl-spiro-dinaphthopyran, 3,3'-dichlorospirodinaphthopyran, 3-benzyl-spiro-dinaphthopyran, 3-methyl-naphtho-(3-methoxybenzo)spiro-pyran, 3-propyl-spiro-dibenzopyran, and so on.

These compounds well-known as colorless dyes are described, for example, in U.S. Pat. Nos. 3,491,111, 3,491,112, 3,491,116, 3,509,174, 3,624,107, 3,627,787, 3,641,011, 3,462,828, 3,681,390, 3,920,510, 3,959,571, 3,971,808, 3,775,424, 3,853,869, 4,246,318, etc.

Electron-accepting compounds, hereinafter referred to as color developers, which can give coloration by contact with the colorless dyes and which are used in the present invention include inorganic and organic Lewis acids and Brϕnsted acids. Specifically, they include phenol derivatives, salicyclic acid derivatives, metal salts of aromatic carboxylic acids, acid clay, bentonite, novolak resins, and metal-processed novolak resins. More specifically, there are cited organic color developers, e.g., phenol derivatives such as 4-tert-butylphenol, 4-phenylphenol, 4-hydroxydiphenoxide, α-naphthol, β-naphthol, hexyl-4-hydroxybenzoate, 2,2'-dihydroxybiphenyl, 2,2-bis-(4-hydroxyphenyl)propane (i.e., bisphenol A), 4,4'-isopropylidenebis(2-methylphenol), 1,1-bis-(3-chloro-4-hydroxyphenyl)cyclohexane, 1,1-bis(3-chloro-4-hydroxyphenyl)2-ethyl-butane, 4,4'-sec-isooctylidenediphenol, 4-tert-octylphenol, 4,4'-sec-butylidenediphenol, 4-p-methylphenylphenol, 4,4'-iso-pentylidenediphenol, 4,4'-methylcyclohexylidenediphenol, 4,4'-dihydroxydiphenyl sulfide, 1,4-bis-4'-hydroxycumylbenzene, 1,3-bis-4'-hydroxycumylbenzene, 4,4'-thiobis-(6-tert-butyl-3-methylphenol), 4,4'-dihydroxydiphenyl sulfone, 4,4-dihydroxydiphenyl sulfone mono isopropyl ether, hydroquinone monobenzyl ether, 4-hydroxybenzophenone, 2,4-di-hydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenyl sulfone, 1,5-bis-p-hydroxyphenylpentane, 1,6-bis-p-hydroxyphenoxyhexane, tolyl 4-hydroxybenzoate, α-phenylbenzyl-4-hyddroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chloro-benzyl 4-hydroxybenzoate, β-phenethyl 4-hydroxybenzoate, 4-hydroxy-2',4'-dimethyldiphenyl sulfone, β-phenethyl orsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-tert-butyl-4'-hydroxy-phenoxyethyl 2,4-dihydroxybenzoate, 1-tert-butyl-4-p-hydroxyphenylsulfonyloxybenzene, 4-N-benzylsulfamoylphenol, p-methyl-benzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, ditolyl thiourea, and 4,4'-diacetyldiphenyl thiourea, salicyclic acid derivatives such as 3-phenylsalicylic acid, 3-cyclohexylsalicyclic acid, 3,5-di-tert-butysalicyclic acid, 3,5-di-dodecylsalicyclic acid, 3-methyl-5-benzylsalicyclic acid, 3-phenyl-5-(α,α-dimethylbenzyl)salicylic acid, 3,5-di-(α-methylbenzyl)salicylic acid, and 3,5-di-cyclopentadienylsalicylic acid, aromatic carboxylic acid derivatives such as 2-hydroxy-1-benzyl-3-naphthoic acid, aliphatic carboxylic acids such as oxalic acid, maleic acid, tartaric acid, citric acid, succinic acid, and stearic acid, aromatic carboxylic acids such as benzoic acid, p-tert-butylbenzoic acid, phthalic acid, gallic acid and the like, and phenol resins such as p-phenylphenol-formaldehyde resins, p-butylphenol-acetylene resin, a carboxy-modified product of terpene phenol resins comprising a gum turpentine and a phenol, and a carboxy-modified product of terpene addition phenol comprising a dipentene (2 mol) and a phenol (1 mol); salts of these organic color developers and polyvalent metals such as zinc, magnesium, aluminium, calcium, titanium, manganese, tin, nickel, etc.; inorganic color developers including inorganic acids such as hydrohalogenic acids (e.g., hydrochloric acid, hydrobromic acid, and hydroiodic acid), boric acid, silicic acid, phosphoric acid, sulfuric acid, nitric acid, perchloric acid, and metal halides of a metal such as aluminium, zinc, nickel, tin, or titanium, and a halogen such as boron and the like, acid clay, activated clay, attapulgite, bentonite, colloidal silica, aluminium silicate, magnesium silicate, zinc silicate, tin silicate, zinc rhodanide, zinc chloride, iron stearate, cobalt naphthenate, nickel peroxide, ammonium nitrate and the like, and so on. These electron-accepting compounds may be used alone or as a mixture of two or more thereof.

Among these electron-accepting compounds, salicylic acid derivatives having 15 or more carbon atoms or metal salts thereof are preferably used together with the colorless dyes of formula (I) of the present invention in view of light fastness of the color developed image. The salicylic acid derivatives are preferably di-substituted salicylic acid derivatives. Substituents for the salicylic acid derivatives include an alkyl group having 1 to 18 carbon atoms, an aralkyl group having 7 to 20 carbon atoms, an alicyclic group, an alkoxy group having 1 to 18 carbon atoms, which may be substituted, an aryl group, an arylsulfonyl group, and a halogen atom, etc.

In applying the foregoing colorless dyes and electron-accepting compounds each to a recording material, they are used in the form of fine dispersion or fine droplets.

When used for pressure-sensitive paper, the colorless dyes and the elcrtron-accepting compounds can assume various forms, such as those described in prior patents, e.g., U.S. Pat. Nos. 2,505,470, 2,505,471, 2,505,489, 2,548,366, 2,712,507, 2,730,456, 2,730,457, 3,103,404, 3,418,250 and 4,010,038, and so on. Quite commonly, a recording material is made up of at least a pair of sheets one of which contains an electron-donating colorless dye and the other of which contains an electron-accepting compound.

As methods for encapsulation, there are known the methods described in U.S. Pat. Nos. 2,800,457 and 2,800,458, in which coacervation of hydrophilic colloid sol are utilized; interfacial polymerization methods as described in British Pat. Nos. 867,797, 950,443, 989,264 and 1,091,076, and so on; the technique described in U.S. Pat. No. 3,103,404; and so on.

In general, one or more of the foregoing electron-donating colorless dyes are dissolved in a solvent (e.g., synthetic oils such as alkylated naphthalene, alkylated diphenyl, alkylated diphenylmethane, alkylated terphenyl, chlorinated paraffin, etc.; vegetable oils such as cotton seed oil, castor oil, etc.; animal oils; mineral oils; or mixtures of two or more thereof), microencapsulated, and coated on a support, such as paper, wood free paper, plastic sheet, resin-coated paper or the like, to prepare a color former sheet. As for the support to be used, neutralized paper is particularly desirable.

One or more of the foregoing electron-accepting compounds alone or together with other electron-accepting compounds are dispersed into a binder such as a styrene-butadiene latex, polyvinyl alcohol or the like, and coated together with a pigment described hereinafter on a support, such as paper, plastic sheet, resin-coated paper or the like, to prepare a color developer sheet.

The amounts of electron-donating colorless dyes and electron-accepting compounds to be used in the present invention depend on an intended thickness of the coat, the form of the pressure-sensitive copying paper, the method of preparation of microcapsules, and other conditions. The amount of each may be properly chosen according to desired use and conditions. Determination of the proper amounts is easy to one skilled in the art.

When used for heat-sensitive paper, the electron-donating colorless dyes and the electron-accepting compounds are ground to fine particles having a diameter of 10 microns or less, preferably 3 microns or less, and dispersed in a dispersion medium. In general, an aqueous solution containing a water-soluble high polymer in a concentration of about 0.5 to 10% is used as the dispersion medium, and dispersion is carried out using a ball mill, a sand mill, a horizontal type sand mill, an attritor, a colloid mill, or the like. In the case of heat-sensitive recording materials, the electron-donating colorless dyes and the electron-accepting compounds can be preferably used at a weighr ratio of from about 1:20 to 1:1, and more preferably from about 1:10 to 2:3.

In the preparation of the dispersion, it is preferable to use, in combination with the electron-donating colorless dyes or the electron-accepting compounds, heat-fusible compounds having a melting point of 75° C. to 130° C., such as nitrogen-containing organic compounds, e.g., fatty acid amides, acetoacetic anilide, diphenylamine, benzamide, carbazole, etc.; 2,3-di-m-tolylbutane, o-fluorobenzoyldurene, chlorobenzoylmesitylene, 4,4'-dimethylbiphenyl; carboxylic acid esters, e.g., dimethyl isophthalate, diphenyl phthalate, dimethyl terephthalate, methacryloxybiphenyl, etc.; polyether compounds, e.g., di-m-tolyloxyethane, β-phenoxyethoxyanisole, 1-phenoxy-2-p-ethylphenoxyethane, bis-β-(p-methoxyphenoxy)ethoxymethane, 1-2'-methylphenoxy-2,4'-ethylphenoxyethane, 1-tolyloxy-2-p-methyl-phenoxyethane, 1,2-diphenoxyethane, 1,4-diphenoxybutane, bis-β-(p-ethoxyphenoxy)ethyl ether, 1-phenoxy-2-p-chlorophenoxyethane, 1,2'-methylphenoxy-2,4''-ethyloxyphenoxyethane, 1-4'-methylphenoxy-2,4''-fluorophenoxyethane, bis-β-(p-methoxyphenoxy)ethyl ether, 1,2-bis(p-methoxyphenylthio)ethane, N-benzyl phenyl acetoamide, etc. These compounds are finely dispersed together with either the electron-donating colorless dyes or the electron-accepting compounds. In particular, it is preferred to disperse these compounds and the colorless dyes at the same time from the standpoint of prevention of fog. They are used in a proportion of 20 to 300% by weight, preferably 40 to 150% by weight, based on the weight of the electron-accepting compounds.

To the thus obtained coating composition are further added additives for the purpose of satisfying various particular requirements.

As an example of additives, mention may be made of an oil absorbing substance, such as an inorganic pigment, polyurea filler, etc., which is dispersed in a binder in order to prevent the contamination of a recording head upon recording. As another example of additives, a fatty acid, a metal soap or the like is used in order to improve release characteristics toward a recording head. Further, additives including pigments, wax, an antistatic agent, an ultraviolet absorbent, a defoaming agent, a conductivity imparting agent, a brightening dye, a surface active agent and so on are generally coated on a support in addition to the electron-donating colorless dyes and the electron-accepting compounds which both contribute directly to color development, thus constituting a recording material.

Specific examples of pigments which can be used in the present invention include kaolin, calcined kaolin, talc, agalmatolite, diatomaceous earth, calcium carbonate, aluminium hydroxide, magnesium hydroxide, calcined plaster, silica, magnesium carbonate, titanium oxide, alumina, barium carbonate, barium sulfate, mica, microballoon, urea-formaldehyde filler, polyethylene particles, cellulose filler and so on, whose particle sizes are adjusted to 0.1 to 15 microns.

Specific examples of waxes which can be used in the present invention include paraffin wax, carboxy-modified paraffin wax, carnauba wax, microcrystalline wax, polyethylene wax, and higher fatty acid esters.

Specific examples of metal soaps which can be used in the present invention include polyvalent metal salts of higher fatty acids, such as zinc stearate, aluminium stearate, calcium stearate, zinc oleate and the like.

These additives are dispersed into a binder, and coated. As for the binder, water-soluble binders are generally employed. Specific examples of such binders include polyvinyl alcohol, hydroxyethyl cellulose, hydroxypropyl cellulose, epichlorohydrin-modified polyamide, ethylene-maleic anhydride copolymer, styrene-maleic anhydride copolymer, isobutylene-maleic anhydride copolymer, polyacrylic acid, polyacrylamide, methylol-modified polyacrylamide, starch derivatives, casein, gelatin and so on. For the purpose of imparting water-resisting property to these binders, a water resistance-imparting agent (e.g., a gelling agent, a cross-linking agent or so on), or an emulsion of a hydrophobic polymer, such as a styrene-butadiene rubber latex, an acrylic resin emulsion or the like, can be added. The thus prepared coating composition is coated on base paper, wood free paper, plastic sheet, synthetic paper or neutralized paper at a coverage of about 2 to 10 g/m$^2$.

Further, a protective layer about 0.2 to 2 microns thick, which is comprised of a water-soluble or water-dispersible micromolecular compound, such as polyvinyl alcohol, hydroxy-ethyl starch or epoxy-modified polyacrylamide, and a cross-linking agent, can be provided on the surface of the coated layer to enhance resistance.

When applied to heat sensitive paper, the recording material of the present invention can further have various embodiments as described in West German Patent Application (OLS) Nos. 2,228,581 and 2,110,854, Japanese Patent Publication No. 20142/77, and so on. In addition, a pre-heating, humidity control, stretching or like procedure can be given to the coated paper prior to recording.

Electro thermo-recording paper is produced according to the methods as described in Japanese Patent Application (OPI) Nos. 11344/74 and 48930/75, and so on. In general, the electro thermo-recording paper is produced by coating on a support such as paper a coating composition in which a conductive substance, an electron-donating colorless dye, and an electron-accepting compound are dispersed together with a binder, or by coating on a support a conductive substance to form a conductive layer, and coating thereon a coating composition in which an electron-donating colorless dye, an electron-accepting compound and a binder are dispersed. Further, a heat fusible compound as described hereinbefore can be used together with the above-described constituents in order to heighten the sensitivity.

Light- and pressure-sensitive paper is produced according to the methods as described, e.g., in Japanese Patent Application (OPI) No. 179836/82. In general, a photopolymerization initiator, e.g., silver iodobromide, silver bromide, silver behenate, Michler's ketone, a benzoin derivative, a benzophenone derivative or so on, and a cross-linking agents, e.g., a polyfunctional monomer like a polyallyl compound, poly(meth)acrylate, poly(meth)acrylamide, or so on, are enclosed together with the colorless dyes, and optionally a solvent, in capsules whose wall is made up of a synthetic resin, e.g., polyether urethane, polyurea or the like. After image-wise exposure, the colorless dyes present in unexposed areas, when brought into contact with a color developer (electron-accepting compound), result in coloration.

The electron-donating colorless dyes of formula (I) of the present invention may be prepared in accordance with known processes such as disclosed in U.S. Pat. Nos. 3,829,322 and 4,062,866. For instance, a corresponding benzoylbenzoic acid or benzoylpyridine carboxylic acid is made to react with indole, or a corresponding carboxybenzoylindole or carboxypyridinecarbonylindole is made to react with an aniline derivative in the presence of a condensing agent, such as acetic anhydride, phosphorus oxychloride or so on, if necessary, using a volatile organic inert solvent, such as chloroform, benzene, chlorobenzene, etc., at a reaction temperature from 50° C. to 140° C. for 10 to 120 minutes. The reaction mixture is poured into ice-cold water to hydrolize the condensing agent, the volatile organic inert solvent is further added thereto, the liquids are rendered alkaline by addition of an aqueous solution of sodium hydroxide, the solvent layer alone is taken out, and the solvent is distilled away under reduced pressure to obtain the intended colorless dye.

The present invention will now be illustrated in more detail by reference to the following examples and comparative examples. However, the invention should not be construed as being limited to the following examples. Unless otherwise indicated, all parts, percents and ratios are by weight.

Examples 1 to 16 and Comparative Examples 1 to 3

Eight pressure sensitive recording materials and a Comparative recording material were each comprised of a color former sheet containing the respective electron-donating colorless dye indicated on table 1 below, and a color developer sheet containing the respective electron-accepting compound indicated on Table 1.

(1) Preparation of Color Developer Sheet

Ten parts of the electron accepting compound set forth in Table 1 under Example 1 was added as a color developer to 20 parts of 1-isopropylphenyl-2-phenylethane, and heated at 90° C. to prepare a solution. The solution was added to 50 parts of a 2% aqueous solution of polyvinyl alcohol (PVA-117, produced by Kuraray Co., Ltd.), and thereto additionally 0.1 part of a 10% aqueous solution of triethanolamine salt of dodecylbenzenesulfonic acid as a surface active agent was added. The resulting mixture was emulsified using a homogenizer untill the mean particle size of the emulsion became 3 microns.

Then, 80 parts of calcium carbonate, 20 parts of zinc oxide and 1 part of sodium hexametaphosphate were dispersed in 200 parts of water using a Kedy mill to prepare a dispersion. The dispersion was mixed with the foregoing emulsion, and further thereto were added 100 parts of a 10% aqueous solution of PVA-117 (produced by Kuraray Co., Ltd.) and 10 parts (on a solids basis) of carboxy-modified SBR latex (SN-307, produced by Sumitomo Naugatuc Co., Ltd.) as a binder. Water was added to the resulting emulsion in such an amount that the solids concentration was adjusted to 20% by weight. Thus, the coating composition (A) was prepared.

Separately, 10 parts of the same color developer, 20 parts of Silton clay, 60 parts of calcium carbonate, 20 parts of zinc oxide, 1 part of sodium hexametaphosphate and 200 parts of water were mixed and made into a homogeneous dispersion having a mean particle size of 3 microns using a sand grinder.

To the dispersion obtained, 16 parts of a 10% aqueous solution of PVA-103 (produced by Kuraray Co., Ltd.) was first added, and then 100 parts of 10% aqueous solution of PVA-117 (produced by Kuraray Co., Ltd.) and 10 parts (on a solids basis) of carboxy-modified SBR latex (SN-307, produced by Sumitomo Naugatuc Co., Ltd.) were added. Further, water was added so that the solids concentration was adjusted to 20%. Thus, the coating composition (B) was prepared.

The coating composition (A) and the coating composition (B) were mixed in the ratio of 50 parts to 50 parts based on the total weight of color developer, coated on a base paper having a base weight of 50 g/m$^2$ at a dry solids coverage of 5.0 g/m$^2$ using an air knife coater, and dried to obtain a color developer sheet.

Seven such color developer sheets are made, one for each of Examples 1, 2, 3, 5, 6, 7, and Comparison Example 1.

The above procedure was repeated, except that the electron accepting compound set forth in Table 1 under Example 4 was used in place of the electron accepting compound employed in Example 1. Two such color developer sheets having the electron accepting compound set forth under Example 4 were made, with one being used in Example 4 and the other being used in Example 8.

(2) Preparation of Color Former-containing Capsule Sheet (I) Melamine/Formaldehyde Resin Capsule Five parts of a partial sodium salt of polyvinylbenzene sulfonic acid (produced by National Starch Co., trade name: VERSA, TL 500, average molecular weight: 500,000) was added with stirring to 95 parts of water heated up to about 80° C., and dissolved therein over a period of about 30 minutes. Then, the hot solution was cooled, and the pH was determined to be 2–3. The solution was adjusted to pH 4.0 by the addition of a 20 wt% aqueous solution of sodium hydroxide. Then, 100 parts of diisopropylnaphthalene, in which the electron-donating colorless dye set forth in Table 1 under Example 1 was dissolved as a color former in a concentration of 3.5%, was dispersed into 100 parts of the foregoing 5% aqueous solution of the partial sodium salt of polyvinylbenzenesulfonic acid in the form of an emulsion having a mean particle diameter of 4.5 microns. Separately, 6 parts of melamine, 11 parts of a 37 wt% aqueous solution of formaldehyde and 30 parts of water were admixed and heated to 60° C. with stirring. After the lapse of 30 minutes, a transparent aqueous mixture composed of melamine, formaldehyde and a melamine/formaldehyde initial condensate was obtained. The pH of the aqueous mixture was between 6 and 8. This transparent aqueous mixture is hereinafter called the initial condensate solution. The initial condensate solution obtained in the above-described manner was admixed with the foregoing emulsion, and then the mixture was adjusted to pH 6.0 by addition of a 3.6 wt% phosphoric acid solution, followed by 360 minutes of stirring at 65° C. The thus prepared capsule containing solution was cooled to room temperature, and adjusted to pH 9.0 by addition of a 20 wt% sodium hydroxide solution.

To the thus prepared capsule-dispersed solution, 200 parts of a 10 wt% aqueous solution of polyvinyl alcohol and 50 parts of starch granules were added. Further, water was added thereto in such an amount that the solids concentration was adjusted to 20%. Thus, a coating composition in which microcapsules were dispersed was prepared.

The coating composition was coated on a base paper having a base weight of 50 g/m$^2$ at a solids coverage of 5 g/m$^2$ using an air knife coater, and dried to obtain a color former-containing capsule sheet to be used in the present invention.

The above procedure of forming a color former-containing capsule sheet was repeated four times, except that each time a different electron-donating colorless dye as set forth in Table 1 under Examples 4, 5, 8, and Comparative Example 1 was employed in place of the colorless dye used in Example 1.

(II) Polyurethaneurea Capsule

An oily solution prepared by dissolving as a color former the electron-donating colorless dye set forth in Table 1 under Example 2 into 30 g of diisopropylnaphthalene in a concentration of 3.5%, was admixed with 8 g of a polyisocyanate compound (an adduct of 3 mole of tolylenediisocyanate and 1 mole of trimethylol propane) and 1 g of a polyhydroxy compound (an adduct of ethylenediamine and propylene oxide) as wall film-forming substances at a temperature below 20° C. to prepare a primary solution.

Separately, 3 g of polyvinyl alcohol and 1.5 g of a sodium salt of carboxymethyl cellulose were dissolved in 44 g of water at 20° C. Thereto, 0.1 g of Turkey red oil (an emulsifying agent) was added to prepare a secondary solution. The primary solution was poured into the vigorously stirred secondary solution to form an oil-in-water type emulsion. The stirring was lessened just as the size of oil droplets became 4.5 microns, and 100 g of 20° C. water was added to the emulsion. Thereafter, the temperature of the emulsion system was raised gradually to 75° C., and kept there for 60 minutes.

To the thus obtained capsule solution were added 25 g of a 15% aqueous solution of polyvinyl alcohol, 42 g (on a solids basis) of carboxy-modified SBR latex and 20 g of starch granules (mean granular size: 15 microns).

Then, the solids concentration was adjusted to 20% by addition of water to prepare a coating composition.

This coating composition was coated on a base paper having a base weight of 50 g/m$^2$ at a dry solids coverage of 5 g/m$^2$ using an air knife coater, and dried to obtain a microcapsule sheet.

The above procedure was repeated, except that the electron-donating colorless dye set forth in Table 1 under Example 6 was employed in place for the colorless dye used in Example 2.

(III) Gelatin Capsule

Twenty parts of acid-processed gelatin having an isoelectric point of 8.0 and 20 parts of gum arabic were dissolved in 120 parts of 40° C. water, and thereto 0.4 part of sodium alkylbenzenesulfonate as an emulsifying agent, and 200 parts of diisopropylnaphthalene, in which as color former the electron-donating colorless dye set forth in Table 1 under Example 3 was dissolved in a concentration of 3.5%, were mixed with vigorous stirring to make an emulsion. When the size of the oil droplets became 4.5 microns, 200 parts of 40° C. water was added to the emulsion to suppress the progress of emulsification.

Further, 420 parts of 30° C. water was added to the emulsion with stirring, and the pH of the emulsion system was adjusted to 4.4 by addition of a 20% acetic acid solution. The stirring was further continued, and the emulsion was cooled to 8° C. Thereto, 1.0 part of a 37% formaldehyde solution and 1.5 parts of a 20% glutaraldehyde solution were added.

Successively, 60 parts of a 10% aqueous solution of carboxymethyl cellulose was poured thereinto, and then the emulsion system was adjusted to pH 9.5 by dropwise addition of a 25% sodium hydroxide solution. Thereafter, the temperature of the emulsion system was raised to 30° C. to obtain microcapsules having a hardened wall. To the thus prepared capsule-dispersed solution, 200 parts of a 10% aqueous solution of polyvinyl alcohol and 50 parts of starch granules were added, and the solids concentration was adjusted to 20% by further addition of water, thus preparing a microcapsule-dispersed coating composition.

This coating composition was coated on a base paper having a base weight of 50 g/m$^2$ at a dry solids coverage of 5 g/m$^2$ using an air knife coater, and dried to obtain a color former-containing capsule sheet.

The above procedure was repeated, except that the electron-donating colorless dye set forth in Table 1 under Example 7 was employed in place of the colorless dye used in Example 3.

The color developer sheets and the color former-containing capsule sheets obtained in the above-described manners were so combined as shown in table 1 to prepare pressure sensitive recording sheets. The properties of each combination were examined.

Each color developer sheet was brought into a face-to-face contact with each color former-containing sheet to cause color developement, and the light resistance test described below was carried out. The results obtained are shown in Table 1.

TABLE 1

| Example No. | Electron-donating Colorless Dye | Electron-accepting Compound | Capsule | Light Resistance Test |
|---|---|---|---|---|
| 1 | 3-[4-diethylamino-2-(β-4-methoxy phenoxyethoxy)phenyl]-3-(1-n-octyl-2-methylindol-3-yl) phthalide | Zinc 3,5-bis(α-methylbenzyl) salicylate | Melamine/ Formaldehyde Resin Capsule | Excellent |
| 2 | 3-[4-Diethylamino-2-(γ-ethoxy-propoxy)phenyl]-3-(1-ethyl-2-methylindol-3-yl)phthalide | Zinc 3,5-bis(α-methylbenzyl) salicylate | Polyurethane-urea Capsule | Excellent |
| 3 | 3-[4-Diethylamino-2-(β-phenoxy-ethoxy)phenyl]-3-(1-ethyl-2-methylindol-3-yl)phthalide | Zinc 3,5-bis(α-methylbenzyl) salicylate | Gelatin Capsule | Excellent |
| 4 | 3-[4-Diethylamino-2-(β-4-methoxy-phenoxyethoxy)phenyl]-3-(1-ethyl-2-methylindol-3-yl) phthalide | Zinc 5-α-(α-methylbenzyl)-phenethylsalicylate | Melamine/ Formaldehyde Resin Capsule | Excellent |
| 5 | 3-(4-Diethylamino-2-benzyloxy-phenyl)-3-(1-ethyl-2-methylin-dol-3-yl)phthalide | Zinc 3,5-bis(α-methylbenzyl-salicylate | Melamine/ Formaldehyde Resin Capsule | Excellent |
| 6 | 3-[4-Diethylamino-2-(4-methyl-benzyloxy)phenyl]-3-(1-ethyl-2-methylindol-3-yl)phthalide | Zinc 3,5-bis(α-methylbenzyl-salicylate | Polyurethane-urea Capsule | Excellent |
| 7 | 3-[4-Diethylamino-2-(4-methoxy-benzyloxy)phenyl]-3-(1-ethyl-2-methylindol-3-yl)phthalide | Zinc 3,5-bis(α-methylbenzyl-salicylate | Gelatin Capsule | Excellent |
| 8 | 3-[4-Diethylamino-2-(β-phen-ethyloxy)phenyl]-3-(1-ethyl-2-methylindol-3-yl)phthalide | Zinc 5-α-(-methylbenzyl)-phenethylsalicylate | Melamine/ Formaldehyde Resin Capsule | Excellent |
| Compar-ison 1 | Crystal Violet lactone | Zinc 3,5-bis(α-methylbenzyl-salicylate | Melamine/ Formaldehyde Resin Capsule | Poor |

(Light Resistance Test of Developed Color Material)

The developed color material was irradiated with light of 32,000 lux for 10 hours, and the remaining percent of the developed color material was determined by comparing the color density before the irradiation with that after the irradiation according to the equation:

$$\text{Remaining Percent of Developed Color Material} = \frac{\text{Color density of developed color material after test}}{\text{Color density of developed color material before test}} \times 100(\%)$$

The results of light resistance test were rated as follows and shown in Table 1.

| | |
|---|---|
| 75% or more: | Excellent |

-continued

| | |
|---|---|
| 50 to 75%: | Good |
| 25 to 50%: | Poor |
| 25% or less: | Very poor |

Color density was measured by RD-918 type densitometer (mannfactured by Macbeth Co.,)

In addition, solubilities in aromatic solvents of the color formers of the present invention and comparative Examples were measured at 25° C., and the results thereof are shown in Table 2.

TABLE 2

| Example No. | Electron-donating Colorless Dye | Aromatic Solvent | Solubiltiy (%) |
|---|---|---|---|
| 9 | 3-[4-diethylamino-2-(β-4-methoxy phenoxyethoxy)phenyl]-3-(1-n-octyl-2-methylindol-3-yl) phthalide | Diisopropylnaphthalene | above 7 |
| 10 | 3-[4-Diethylamino-2-(γ-ethoxy-propoxy)phenyl]-3-(1-ethyl-2-methylindol-3-yl)phthalide | Diisopropylnaphthalene | above 7 |
| 11 | 3-[4-Diethylamino-2-(β-phenoxy-ethoxy)phenyl]-3-(1-ethyl-2-methylindol-3-yl)phthalide | Diisopropylnaphthalene | above 7 |
| 12 | 3-[4-Diethylamino-2-(β-4-methoxy-phenoxyethoxy)phenyl]-3-(1-ethyl-2-methylindol-3-yl) phthalide | Diisopropylnaphthalene | above 7 |
| 13 | 3-(4-Diethylamino-2-benzyloxy-phenyl)-3-(1-ethyl-2-methylindol-3-yl)phthalide | Diisopropylnaphthalene | above 7 |
| 14 | 3-[4-Diethylamino-2-(4-methyl-benzyloxy)phenyl]-3-(1-ethyl-2-methylindol-3-yl)phthalide | Diisopropylnaphthalene | above 7 |
| 15 | 3-[4-Diethylamino-2-(4-methoxy-benzyloxy)phenyl]-3-(1-ethyl-2-methylindol-3-yl)phthalide | Diisopropylnaphthalene | above 7 |
| 16 | 3-[4-Diethylamino-2-(β-phen-ethyloxy)phenyl]-3-(1-ethyl-2-methylindol-3-yl)phthalide | Diisopropylnaphthalene | above 7 |
| Comparison 2 | Crystal Violet lactone | Diisopropylnaphthalene | 2.5 |
| Comparison 3 | 3-(4-Diethylamino-2-methoxy-phenyl)-3-(1-ethyl-2-methylindol-3-yl)phthalide | Diisopropylnaphthalene | 2 |

As can be seen from the results in Table 1 and Table 2, the recording materials of the present invention were much better in light resistance and solubility in an organic solvent than conventional materials.

Example 17

30 parts of 3-[4-diethylamino-2-(β-4-methoxyphenoxyethoxy)phenyl]-3-(1-ethyl-2-methylindol-3-yl)phthalide, 150 parts of a 10% aqueous solution of polyvinyl alcohol and 70 parts of water were mixed and ground for 12 hours using a ball mill to prepare a dispersion. The particle size after grinding was about 1.5 microns. The resulting composition is hereinafter referred to as Component A.

Separately, 30 parts of zinc 4-β-(p-methoxyphenoxy)ethoxysalicylate, 30 parts of 2-benzyloxynaphthalene, 150 parts of a 10% aqueous solution of polyvinyl alcohol and 55 parts of water were mixed and ground using a sand mill to prepare a dispersion. The particle size of the insoluble matter after grinding was about 2 microns. The resulting composition is hereinafter referred to Component B.

Then, 5 parts of Component and 40 parts of Component B were mixed, coated on paper at a coverage of 6 g/m$^2$, and dried to produce a heat-sensitive paper.

This heat sensitive paper developed blue color by heating with a heat pen or like means. The color image obtained was quite stable to light, and hardly suffered changes in hue and density even by one-hour's irradiation with an ultraviolet lamp (Ricopy-Super-Dry 1,000 manufactured by Ricoh Company, Ltd.).

Example 18

30 parts of 3-(4-diethylamino-2-benzyloxy)phenyl)-3-(1-ethyl-2-methylindol-3-yl)phthalide, 150 parts of a 10% aqueous solution of polyvinyl alcohol and 70 parts of water were mixed and ground for 12 hours using a ball mill to prepare a dispersion. The particle size after grinding was about 1.5 microns. This dispersion is referred to hereinafter as Component C.

Separately, 30 parts of zinc 4-β-(p-methoxyphenoxy)ethoxysalicylate, 30 parts of 2-benzyloxynaphthalene, 150 parts of a 10% aqueous solution of polyvinyl alcohol, and 55 parts of water were mixed and ground using a sand mill to prepare a dispersion. The particle size of the insoluble matter after grinding was about 2 microns. The resulting composition is hereinafter referred to Component D.

Then, 5 parts of Component C and 40 parts of Component D were mixed, coated on paper at a coverage of 6 g/m$^2$, and dried to produce a heat-sensitive paper.

This heat sensitive paper developed blue color by heating with a heat pen or like means. The color image obtained was quite stable to light, and hardly caused changes in hue and density even by one-hour's irradiation with an ultraviolet lamp (Ricopy-Super-Dry 1,000 manufactured by Ricoh Company, ltd.).

While the invention has been described in detail and with reference to specific embodiments thereof, it will be apparent to one skilled in the art that various changes and modifications can be made therein without departing from the spirit and scope thereof.

What is claimed is:

1. A recording material comprising a support having provided thereon an electron-donating colorless dye and an electron-accepting compound, wherein said electron-donating colorless dye is represented by the following general formula (I):

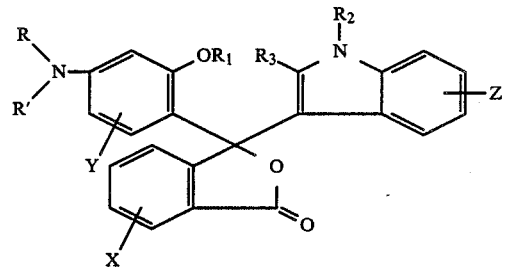

(I)

wherein R and R' each represents an alkyl group; $R_1$ represents an aralkyl group, or an alkyl group substituted with an alkoxy or aryloxy group; $R_2$ and $R_3$, which may be the same or different, each represents a hydrogen atom, an alkyl group, or an aryl group; and X, Y, and Z, which may be the same or different, each represents a hydrogen atom, an alkyl group, an alkoxy group, an aryloxy group, a halogen atom, or a substituted amino group.

2. A recording material as claimed in claim 1, wherein R and R′ each is an unsubstituted alkyl group having 1 to 18 carbon atoms, an alkoxyalkyl group having 2 to 18 carbon atoms, an alkyl group substituted with a halogen atom having 1 to 18 carbon atoms, or an aryloxyalkyl group having 7 to 18 carbon atoms.

3. A recording material as claimed in claim 1, wherein $R_1$ is selected from the group consisting of an aralkyl group having 7 to 18 carbon atoms, an alkoxyalkyl group having 2 to 18 carbon atoms, or an aryloxyalkyl group having 7 to 18 carbon atoms.

4. A recording material as claimed in claim 1, wherein $R_1$ is an aryloxyalkyl group having 7 to 18 carbon atoms.

5. A recording material as claimed in claim 4, wherein $R_1$ is a $\beta$-aryloxyethyl group.

6. A recording material as claimed in claim 1, wherein $R_2$ is (a) a substituted or unsubstituted alkyl group having 1 to 18 carbon atoms, which may be substituted with an aryl group, an alkoxy group, an aryloxy group, or a halogen atom, (b) a phenyl group having 6 to 12 carbon atoms which may be substituted with an alkyl group, an alkoxy group, or a halogen atom, or (c) a hydrogen atom.

7. A recording material as claimed in claim 1, wherein $R_3$ is an alkyl group having 1 to 8 carbon atoms, a phenyl group having 6 to 10 carbon atoms, or a hydrogen atom.

8. A recording material as claimed in claim 1, wherein X, Y, Z each is selected from the group consisting of a hydrogen atom, an alkoxy group having 1 to 6 carbon atoms, an aryloxy group having 6 to 10 carbon atoms, a chlorine atom, a bromine atom, an alkyl group having 1 to 12 carbon atoms, or a substituted amino group.

9. A recording material as claimed in claim 1, wherein the ratio of electron donating colorless dyes to the electron accepting compounds is from 1/20 to 1/1 by weight.

10. A recording material as claimed in claim 9, wherein the ratio of electron donating colorless dyes to the electron accepting compounds is from 1/10 to 2/3 by weight.

11. A recording material as claimed in claim 1, wherein said electron-accepting compound is a salicylic acid derivative having 15 or more carbon atoms, or a metal salt thereof.

12. A recording material as claimed in claim 11, wherein said salicylic acid derivative is di-substituted.

13. A recording material as claimed in claim 1, wherein said recording material is used for heat-sensitive paper.

14. A recording material as claimed in claim 1, wherein said recording material is used for pressure-sensitive paper.

* * * * *